US005182881A

United States Patent [19]

Cox et al.

[11] Patent Number: 5,182,881

[45] Date of Patent: Feb. 2, 1993

[54] AUTOMATED SPINDLE SLURRY SYSTEM

[75] Inventors: Jerry D. Cox, Cincinnati, Ohio; Raymond E. Linz, Wilmington; Jeanne M. Thome, Wrightsville Beach, both of N.C.; Winfield B. Perry, Lexington, Mass.; Franklin O. Hadley, Jr., Stoneham, Mass.; Vladimir A. Knobel, Brookline, Mass.

[73] Assignee: General Electric Company, Cincinnati, Ohio

[21] Appl. No.: 748,130

[22] Filed: Aug. 21, 1991

[51] Int. Cl.[5] ..... B24B 31/06; B24B 31/00; B24B 1/04

[52] U.S. Cl. ..... 51/7; 51/215 CP; 51/317

[58] Field of Search ..... 51/7, 17, 19, 163.1, 51/163.2, 215 R, 215 AR, 215 CP, 281 R, 313, 315, 316, 317; 901/6, 7; 414/223, 225, 741, 728, 416

[56] References Cited

U.S. PATENT DOCUMENTS

| | | | |
|---|---|---|---|
| 2,697,529 | 12/1954 | Hubbell et al. | 414/741 |
| 2,734,316 | 2/1956 | Dawson | 51/7 |
| 2,797,530 | 7/1957 | Garver | 366/101 |
| 3,224,602 | 12/1965 | Mattson | 214/1 |
| 3,459,313 | 8/1969 | Upton et al. | 414/728 |
| 3,464,163 | 9/1969 | Ferrara | 51/8 |
| 3,599,374 | 8/1971 | Porter et al. | 51/7 |
| 4,164,096 | 8/1979 | Kobayashi | 51/7 |
| 4,195,961 | 4/1980 | Waiblinger | 414/741 |
| 4,205,487 | 6/1980 | Anderson et al. | 51/7 |
| 4,480,411 | 11/1984 | Balz et al. | 51/163.1 |
| 4,581,853 | 4/1986 | Marcus | 51/7 |
| 4,706,414 | 11/1987 | Muzik | 51/19 |
| 4,730,417 | 3/1988 | Davidson et al. | 51/7 |
| 4,744,707 | 5/1988 | Negri et al. | 409/7 |
| 4,975,018 | 12/1990 | Langenbacher et al. | 414/751 |

*Primary Examiner*—Bruce M. Kisliuk
*Assistant Examiner*—Bryan Reichenbach
*Attorney, Agent, or Firm*—Jerome C. Squillaro; Charles L. Moore, Jr.

[57] ABSTRACT

An automated abrasive slurry metal finishing machine and process includes a part handler which transfers a metal part to a single spindle which inserts the part into the abrasive slurry for rotation oscillation and pendulum motion of the part in particularly agitated slurry.

20 Claims, 2 Drawing Sheets

AUTOMATED SPINDLE SLURRY SYSTEM

The invention disclosed and claimed herein was made in the performance of work under a U.S. Government contract F33657-85-C-2147 issued by the Department of the Air Force.

BACKGROUND OF THE INVENTION

This invention relates to a large metal part slurry deburring or finishing equipment and process and more particularly to an automated spindle slurry system embodying a combination of an agitated abrasive grit medium or slurry and a single trimotion spindle to provide rotation or oscillation and pendulum motion to a spindle support part in the slurry medium.

Aircraft gas turbine engines include a number of parts or components such as engine frames and casings, compressor and turbine wheels or discs, and various shafting, all of which are manufactured to close tolerances and require careful deburring and edge finishing operations before they are ready for engine assembly. It was a prior practice to remove burrs and rough edges by a manual grinding or finishing operation on each individual part and part section to be finished. Such a manual operation for engine casings, for example, requires an extended work time period and close monitoring to avoid any changes in precise design tolerances. An automatic process which would accommodate large engine parts such as engine casings and turbine and compressor wheel discs, and also apply a deburring and finishing action simultaneously to plural separated regions to be finished would represent significant time and cost savings and increased engine production rates.

OBJECTS OF THE INVENTION

It is a principle object of this invention to provide an improved automated slurry finishing machine which applies an abrasion finishing process to large components of a gas turbine engine for simultaneous finishing of a plurality of separate component regions requiring metal finishing.

It is another object of this invention to provide trimotion of a metal part in an enhanced agitated slurry metal finishing process for large engine components.

It is a further object of this invention to provide a single spindle slurry finishing machine wherein a single spindle provides pendulum, and rotary, or oscillatory motion of a part in a slurry medium.

SUMMARY OF THE INVENTION

A gas turbine engine component is automatically lifted, transferred, and attached to an elevated spindle which lowers and inserts the component into an agitated abrasive slurry medium. The spindle subjects the component to rotary, or oscillatory, and pendulum motions, so that the slurry medium simultaneously abrades and finishes flanges, apertures, and other fitting surfaces which require deburring and finishing.

This invention will be better understood when taken in connection with the following related description and drawings.

BRIEF DESCRIPTION OF THE INVENTION

Figure 1:
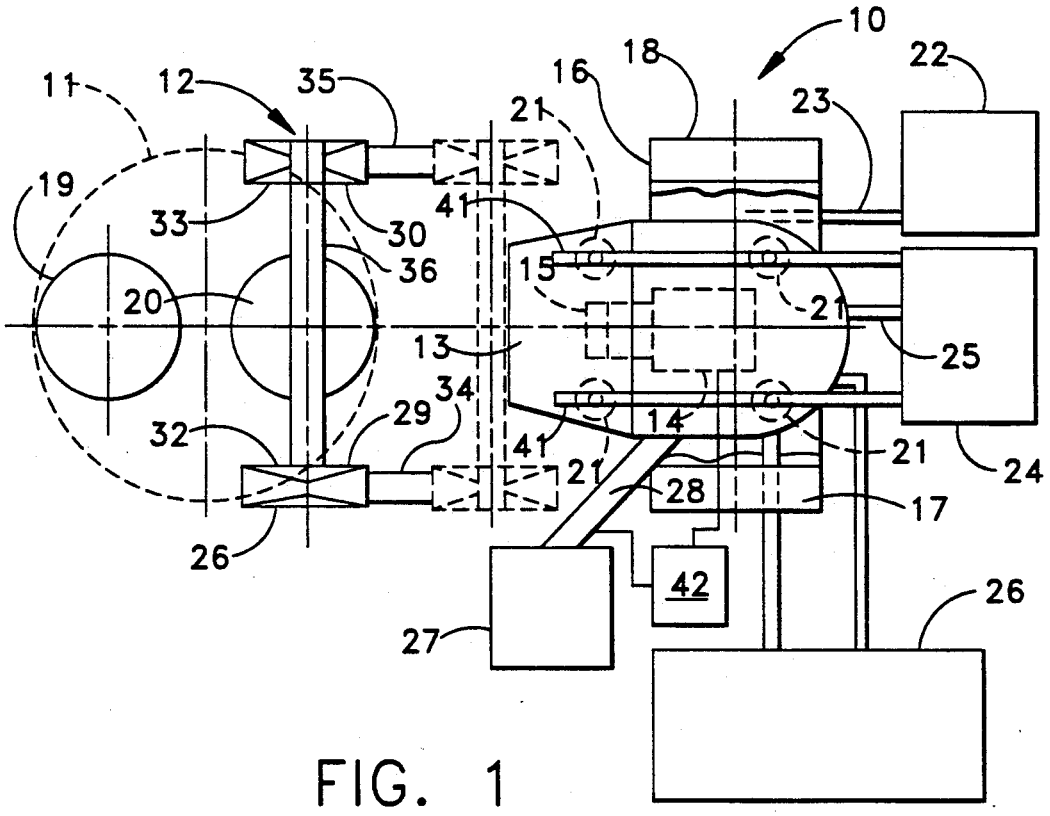
FIG. 1 is a schematic plan view of an integrated automatic slurry deburring system of this invention.
Figure 2:
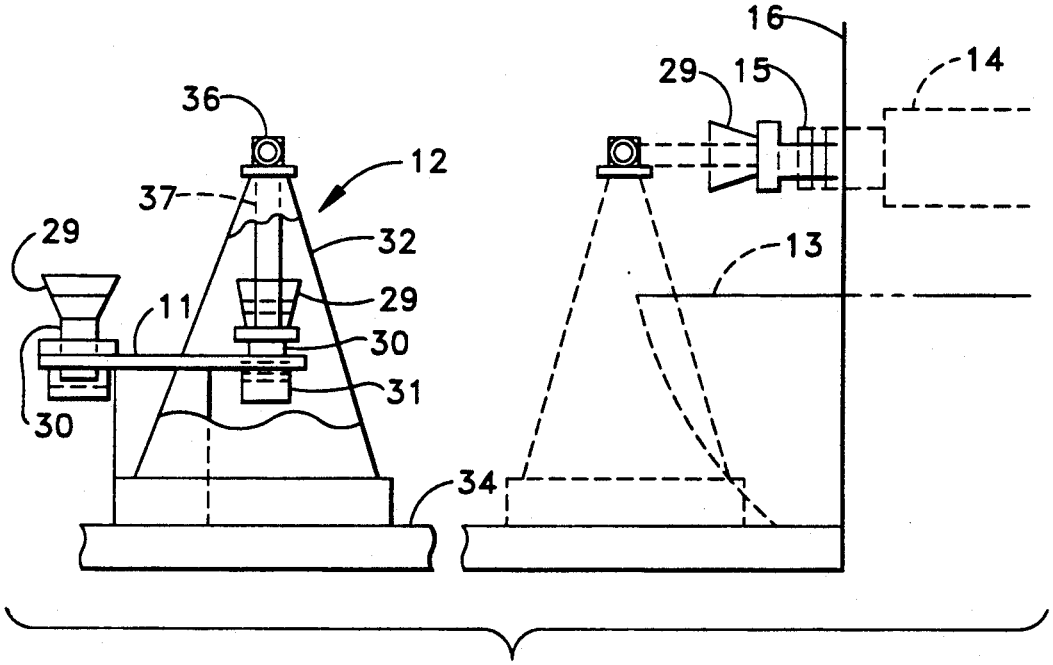
FIG. 2 is a schematic side elevational view of a machine which embodies the system of this invention.

Referring now to FIG. 1, the composite machine 10 of this invention comprises primarily, a two station rotary table 11, a manipulator 12, an open slurry tank or tub 13 and an elevated spindle assembly 14 which comprises a single spindle 15 and its appropriate transversely tilting, mounting and drive mechanisms. Spindle assembly 14 is mounted in a large bifurcated frame member 16 which straddles tub 13 with spaced supports 17 and 18 and supports spindle assembly 14 in an elevated position above tub 13. Spindle assembly 14 is also mounted in its frame 16 to have a controllable hydraulically driven, limited tilting or rocking motion, referred to as pendulum motion or transverse rotation so that spindle 15 traverses an arcuate path in approaching the grit water mixture in tub 13 (FIG. 2).

Briefly, a component to be finished, is fitted with a spindle mounting fixture and loaded on the rotary table 11 in a load station 19. Table 11 is rotated to move the component in load station 19 to a process station 20 which is in a correct machine position with respect to the manipulator 12 frame. A mechanical swing device on the manipulator 12 frame grasps the spindle fixture on the component and moves toward spindle assembly 14 as shown in phantom lines in FIG. 1, to attach the spindle fixture of the component to spindle 15 of spindle assembly 14. Spindle assembly 14 is then programmed to insert the attached component into a grit-water medium in tub 13 for rotation, or oscillation, and pendulum, motion i.e. trimotion, therein where the abrading action of the grit finishes the part.

Tank or rub 13 of machine 10 is an important process component and is adapted to accept various metal engine parts of differing sizes and shapes which are given a trimotion therein for a deburring and finishing process involving the abrasive action of an agitated grit and water mixture or slurry in tub 13.

In one example of this invention, tub 23 was of a size of about 65×96×42 inches I.D. to accommodate gas turbine engine casings as large as about 43 inches in diameter and 1000 lbs. weight. Tub 13 was charged with about 13,000 lbs. of #8.0 $Al_2O_3$ particles. It is a feature of this invention that the finishing process includes the use of a two-fold agitated abrasive slurry, and for that purpose tub 13 is suitably supported for vibration of the $Al_2O_3$ grit it contains. In one example, tub 13 is mounted on a vibration support or table on spaced intermediate flexible mounts 21 shown in phantom lines in FIG. 1. A pair of 7.5 horsepower electric motors are used with a variable control to drive the tub support in the range of about 300–1000 cycles per second. Agitation enhancement is achieved by injecting air under pressure into the vibrating grit-water mixture. For example, a supply of compressed air or an air compressor system is shown generally as 22 in FIG. 1 with one or more air conduits 23 leading to appropriately placed nozzles or injectors in tub 13.

In order to protect tub 13 from the abrasive action of the grit therein, its interior surfaces are lined or coated with a synthetic rubber material. As noted, tub 13 contains a grit-water mixture. Water is added to the $Al_2O_3$ grit in tub 13 to provide a more effective abrasive slurry action and slurry consistency. However, only a few inches of water in tub 13 are required for an effective process. For this purpose a fresh water supply system denoted generally as 24 in FIG. 1 is connected to tub 13 through one or more water supply conduits 25 to deliver water to tub 13. During an abrasion process cycle, grit particles become worn or disintegrate to produce a large amount of fines, and water is expeditiously used to remove fines from tub 13.

For example, tub 13 is equipped with a water filtration system 26 which removes fine laden water from tub 13, filters out the fines and returns fresh water to tub 13 as a closed filtering and recirculation system.

For most effective operation, the agitated grit-water mixture in tub 13 must be maintained within proscribed limits of volume, consistency, and composition, and to do so requires both water and grit replenishment and their monitoring.

An appropriate water supply 24 is connected to tub 13 so that a sufficient and predetermined water level may be maintained. Water level in tub 13 may be appropriately adapted to automated control and supply means.

A grit supply hopper 27 of FIG. 1 is connected to tub 13 through a conveyor such as a screw feed conveyor 28. A grit level system in tub 13 provides an electrical signal which is transmitted to a central control (42) and conveyor 28 to add grit to tub 13 when conditions warrant.

A preferred deburring process includes inserting a part into the agitated grit-water mixture in tub 13 and to maintain this mixture in an agitated state during the deburring process. Some metal parts have curved and complex shapes which include smaller and remote areas to be finished which are somewhat shielded by adjacent surfaces of the complex shape. Finishing of such parts may require extensive finishing procedures and plural machines. For this reason, spindle assembly 14 includes an appropriate drive mechanism and its controls which will rotate or oscillate spindle 15, with its attached part, in the slurry medium in tub 13. Control for spindle assembly 14 is also integrated into the noted central control for separate programming of appropriate rotary or oscillatory cycles. However, bidirectional motion alone, when applied to parts of complex shapes may not cause the slurry to fully reach sheltered areas and remain in abrading contact therewith. Accordingly, an improvement in the finished product may be achieved when the relative position of the part in the grit is changed during the deburring process. For this process, spindle assembly 14 is mounted for tilting or transverse rotation so that the part in the grit is given a slow and limited pendulum-like motion which changes its position in the slurry in tub 13. This feature of the spindle of this invention provides trimotion, i.e. three motions, rotary, or oscillating, and pendulum, to the part being finished. Trimotion of spindle 15 coupled with enhanced grit agitation continuously supplies fresh grit against all regions of the part requiring finishing for more effective finishing in a shorter time cycle. At the same time, the tilting or rocking rotation of spindle assembly 14 also facilitates insertion of a large metal part such as an engine casing into the dense grit medium. For example, pendulum spindle motion permits an angled entry of a large part into the dense medium, an entry which is further expedited by slow rotation of the part during entry. In the machine of this invention, a single spindle assembly 14 is employed for all desired motions. As part of the automatic features of this invention, spindle 15 of assembly 14 (FIG. 1) is equipped with a mechanical grasping device or means which locks itself automatically to a spindle mounting fixture which is pre-attached to a part to be finished, and spindle assembly 14 is then programmed to insert the part into tub 13 for the deburring operation. Various automatic part handlers are available to grasp a part and transport the part from one station to another, for example, from table 11 to spindle 15. A part handler or manipulator as employed in the present invention is described with respect to the schematic machine illustration of FIG. 2.

Referring now to FIG. 2, the major components of machine 10, i.e. work table 11, independent manipulator 12, tub 13, bifurcated frame member 16 and spindle assembly 14 are schematically illustrated in their cooperative interrelationship. Table 11 is a rotatable table with diametrically opposite stations, 19 and 20, respectively, as illustrated in FIG. 1. An automated material handling delivery system (not shown) delivers a component or part to be finished, such as a stainless steel engine casing 29 to outer station 19 of table 11 (FIG. 1). As delivered to table 11, casing 29 includes a spindle fixture part 30 which is preattached to casing 29. Table 11 is rotated so that casing 29 is positioned for pickup by manipulator 12. In this connection, load station 20 of table 11 is equipped with a hydraulic lift cylinder 31 which raises casing 29 and its attached spindle fixture 30 to a correct elevation for manipulator 12, a shown in FIG. 2. As illustrated in FIGS. 1 and 2, manipulator 12 comprises a spaced pair of trapezoidal end frame members 32 and 33 (FIG. 1) which are adapted to roll in spaced parallel tracks 34 and 35 (FIGS. 1 and 2). Positioned transversely across frame members 32 and 33 (FIG. 1) is a power driven shaft support 36. As illustrated in phantom lines in FIG. 2 a hydraulically activated swing frame 37 is affixed to and depends from shaft support 36 as illustrated in perspective in FIG. 3.

Figure 3:
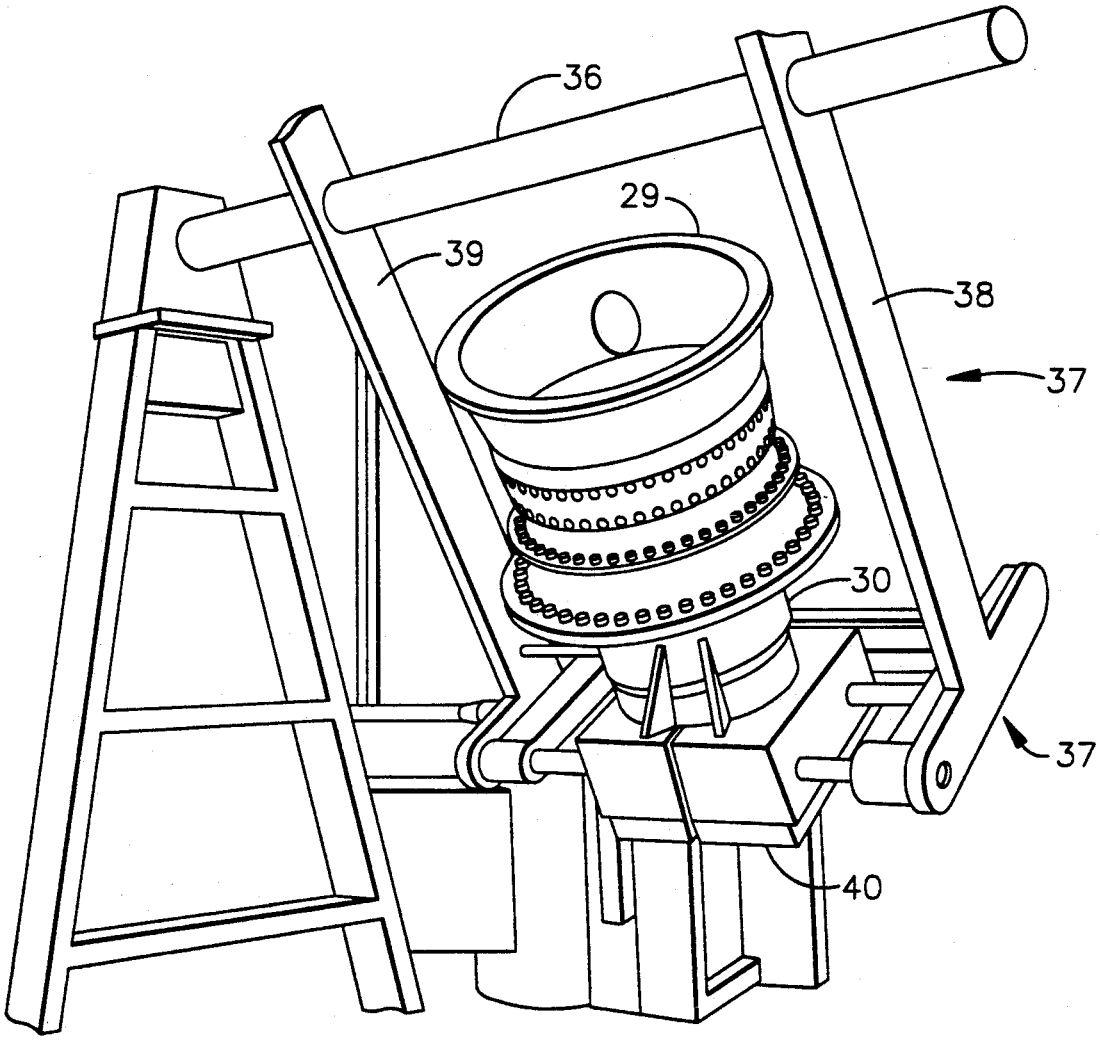
FIG. 3 is a schematic view of an engine casing mounted in a swing frame of the machine of this invention.

Referring to FIG. 3, swing frame 37 comprises a pair of upstanding parallel support arms 38 and 39 together with a casing 29 and spindle fixture 30 supported therebetween. Each arm 38 and 39 is in the general form of an inverted T, and the cross members of the T are spaced to reside oppositely to a casing 29 therebetween. Also, each cross member supports one half of a clamping device 40 in which each half is hydraulically operated to move towards the other to engage spindle fixture 30. Various clamping means may be employed to clamp an object between the cross members of the T arms. In one embodiment of this invention clamping device 40 comprises a pair of semi circular jaws which are moved linearly towards each other to engage spindle fixture 30 therebetween in a circular grasp. At the region of contact, spindle fixture 30 has a cylindrical configuration comparable to the defined opening in the semi circular clamp jaws. As previously described, process station 20 of table 11 includes a hydraulic lift device 31 operable to raise casing 29 and its spindle fixture 30 to a correct vertical position for clamp device 40. After casing 29 is firmly clamped, the noted lift device in table 11 is lowered or retracted and casing 29 is solely supported by swing frame 37 on manipulator 12. Thereafter, a hydraulic drive is activated to rotate swing frame 37 from a vertical casing position at the process station 20 counterclockwise into its phantom line horizontal position shown in FIG. 2. Manipulator 12 is caused to move along its tracks with spindle fixture 30 in alignment with spindle assembly 14. Spindle fixture 30 includes a mating part of an automatic chuck mechanism on spindle 15 so that fixture 30 may be automatically coupled to spindle 15. Clamping device 40 is then retracted to release casing 29 to spindle assembly 14. At this point machine 10 is loaded and ready for the finishing or slurry segment of the overall cycle. Manipulator 12 may then remain in position and be directly available to transfer casing 29 form spindle 15 at the conclusion of the finishing cycle.

With the grit and water medium in tub 13 being fully agitated by mechanical vibration and air injection, spindle assembly 14 is given a transverse rotation or pendulum motion to bring its attached casing 29 into contact with the grit medium in tub 13. At the time of insertion, spindle 15 is caused to coaxially rotate about its own longitudinal axis to facilitate casing insertion. Finishing treatment requires about 30 minutes of abrasion action which includes rotation and oscillation cycles of spindle 15 and casing 29 while inserted in the grit. During this abrasion cycle, spindle assembly 14 undergoes a slow pendulum swing action which provides a desirable change of position of casing 29 in the grit medium for more effective and complete abrasion of surfaces to be finished. During the operation as described, both the pendulum movement and enhanced grit agitation provides a changing supply of grit closely adjacent difficult to reach regions of casing 29 throughout the cycle of operation while at the same time not only preventing excessive dispersion of the grit, due for example, to centrifugal forces from a rotating part, but also preventing excess accumulation of grit along the interior walls of tub 13. After the deburring cycle has run its full course, spindle assembly 14 is programmed to withdraw casing 29 from the grit medium in tub 13 and suspend it in a correct position for water spray washing of collected grit and fines from the part. As illustrated in FIG. 1, water supply system 24 includes one or more conduits 41 connected to appropriately directed water nozzles which spray water against the suspended casing which is rotated for effective water spray cleaning. Thereafter the loading sequence is reversed and the casing returned to table 11, by manipulator 12, where it may be automatically picked up for transfer to other locations and final assembly.

In one practice of this invention all motors and drives were hydraulically driven including manipulator 12 and its drive components, spindle assembly 14 and its trimotion operation. As previously indicated, certain monitoring and control signals are passed to a central control 43. Central control 42 also controls spindle functions. In one example of a functioning machine 10, a central control 42 utilized a General Electric Company Series 6 controller with a 16K memory with an ASC II/Basic module, color operator interface terminal, I.O. modules and expansion characteristics of the foregoing items.

Operating controls for the spindle slurry system include:

(1) Reading control for volume of grit in tub 13;

(2) Setting controls for spindle trimotion;

(3) Reading control for torque applied to spindle motion;

(4) On/off switches for control power, hydraulic pump, slurry medium systems, manual mode automatic mode automatic cycle start/stop, emergency stop.

Salient features which combine to provide an extremely effective deburring machine capable of handling very large objects with complex curved surfaces and separated regions requiring metal finishing, include a particular and independent linearly moving manipulator which picks up a part from a station and moves the part to a spindle for automatic attachment to the spindle followed by, and together with, trimotion of the spindle in a dual agitated (vibration and air injection) water-grit mixture. Heretofore, large engine parts, such as engine casing with curved surfaces and plural regions to be finished, were only considered for manual finishing. It was also found difficult to finish smaller parts with complex surfaces in a grit medium because complex surfaces may require a host of different and independent part motions sometimes with different machines to assure effective grit contact with all surfaces requiring finishing. Trimotion and dual agitation in the machine of the present invention have ameliorated the noted difficulties.

An important advantage of the improved abrasion slurry finishing process of this invention is the use of a single spindle for the combined operation. The single spindle locks to a casing, for example, in position over tub 13, inserts the casing into the slurry in tub 13 and additionally provides trimotion finishing in an agitated grit medium. At the same time the single spindle is amenable to full automatic and computer controlled operation without need for additional subservient machines and machine operating personnel.

In one example, the practice of this invention, a gas turbine casing which required about 20 hours of manual effort to finish all edges and fitting surfaces, was satisfactorily finished by means of this invention in about 2 hours.

With respect to finishing engine casings, it is a preferred practice to limit insertion of the casing into the grit somewhat more than one half the length of the casing. The casing is then withdrawn from the grit for reversal of the casing. The finishing cycle is continued with the reversed casing again inserted into the grit somewhat more than one half the length of the casing.

Insertion of the casing more than about one half its length locates usually an end flange deep into a more dense part of the grit for maximum deburring at the flange and gradual diminishing finishing approaching the mid point of the casing. Upon reversal of the casing the same linear finishing occurs but with the overlap at mid point and the midpoint region is finished comparable to the end flange.

The machine of this invention may be defined as a single workpiece single spindle, single pass machine which takes workpieces to be finished singly and in serial relationship. The machine itself is less complex than it would be if it handled a plurality of workpieces simultaneously. With respect to abrasion in the tub, there is no sharing of grit with other workpieces and as a consequence, there is more fresh grit for the piece undergoing the deburring process. The machine of this invention is demonstrably capable of handling large metal parts (gas turbine engine casings of 43 inches D. and 100# weight) with curving and complex surfaces and effectively finishes separated regions thereon uniformly.

While this invention has been disclosed and described with respect to preferred embodiments, it will be understood by those skilled in the art that various changes and modifications may be made therein without departing from the spirit and scope of the invention set forth in the following claims.

What is claimed is:

1. A finishing machine comprising in combination:

(a) a frame member including a pair of spaced support members and supporting a single spindle and drive means therefor disposed between said support members, (b) an open receptacle member disposed between said spaced support members and below said spindle, (c) an abrading slurry in said receptacle, (d) attaching means connectable to a part for finishing for attaching the part to said spindle, (e) said drive means causing rotation of said spindle transversely to a longitudinal axis of said spindle to insert said attached part into the slurry in said receptacle member, and (f) said drive means further causing rotary selectively or oscillatory cycles about said spindle longitudinal axis and simultaneously causing pendulum motion transverse to said spindle longitudinal axis to provide motion of said part in said slurry.

2. The invention as recited in claim 1 wherein said abrading slurry comprises $Al_2O_3$ in particle form mixed in water.

3. The finishing machine of claim 1, further comprising a manipulator means moveable between a process station, where the part to be finished is picked up, and said spindle, where said manipulator means positions the part for attachment to said spindle.

4. The invention as recited in claim 3 wherein said manipulation means comprises:

(a) a pair of spaced apart end frame members, (b) a transverse support shaft between said end frame members, (c) and a swing frame depending from said support shaft and comprising:

(1) a pair of opposed spaced apart parallel arm members, and (2) a pair of opposed spaced apart moveable clamp members disposed between said arm members and each operable to move towards the other to engage said attaching means therebetween.

5. The finishing machine of claim 3, wherein said manipulator means comprises a swing frame means for grasping said attaching means with the part connected thereto from said process station and for positioning said part for coaxial alignment and attachment to said spindle.

6. The finishing machine of claim 5, wherein said part is a gas turbine engine casing, and said attaching means comprises a fixture for attachment to said casing to facilitate grasping of said casing by said swing frame means and for attaching said casing to said spindle for finishing.

7. The finishing machine of claim 1, further comprising means for agitating said abrading slurry.

8. The finishing machine of claim 7, further comprising means for injecting air under pressure into said abrading slurry to enhance agitation.

9. The finishing machine of claim 7, wherein said open receptacle member has a lined interior surface to protect the receptacle member from damage caused by agitation of said abrading slurry.

10. The finishing machine of claim 1, wherein said abrading slurry is a grit and water mixture and further comprising a closed water filtering and recirculation system for removing fines from said mixture and to return fresh water to said receptacle member.

11. The finishing machine of claim 10, further comprising water supply means for supplying a predetermined level of water to said receptacle member.

12. The finishing machine of claim 10, further comprising means for supplying grit to said receptacle member.

13. The finishing machine of claim 10, further comprising a controller for controlling finishing parameters.

14. The finishing machine of claim 13, wherein said finishing parameters include volume of grit in said receptacle member, motion of said spindle and torque applied to said spindle by said drive means.

15. A finishing machine for a gas turbine engine component, comprising:

a frame including a pair of spaced support members;

a spindle assembly pivotably mounted to said frame between said spaced support members for controllable driven motion in an arcuate path transverse to an axis of rotation of a spindle of said spindle assembly;

an open receptacle member disposed between said spaced support members and below said spindle assembly when said spindle assembly is in an elevated position relative to said receptacle member for receiving a component for finishing, said open receptacle being capable of containing a volume of an abrasive slurry;

means for attaching the component to said spindle of said spindle assembly; and drive means for selectively moving said spindle and the attached component in rotary or oscillatory cycles about said spindle axis of rotation and simultaneously moving said spindle and the attached component in an arcuate path.

16. The finishing machine of claim 15, further comprising a manipulator means moveable between a process station, where the part to be finished is picked up, and said spindle, where said manipulator means positions the component for attachment to said spindle.

17. The finishing machine of claim 16, further comprising a fixture for attachment to the component to facilitate grasping of the component by said manipulator means and for attaching the component to said spindle for finishing.

18. The finishing machine of claim 15, further comprising:

means for agitating said abrasive slurry; and means for injecting air under pressure into said abrasive slurry to enhance agitation.

19. The finishing machine of claim 15, wherein said abrasive slurry is a grit and water mixture and further comprising a closed water filtering and recirculation system for removing fines from said mixture and to return fresh water to said receptacle member.

20. The finishing machine of claim 15, further comprising a controller for controlling finishing parameters.

* * * * *